US005604937A

United States Patent [19]

Davenport

[11] Patent Number: 5,604,937

[45] Date of Patent: Feb. 25, 1997

[54] URINAL SCREEN

[75] Inventor: Robert A. Davenport, Sylvania, Ohio

[73] Assignee: Impact Products, Inc., Toledo, Ohio

[21] Appl. No.: 548,709

[22] Filed: Oct. 26, 1995

[51] Int. Cl.[6] ..... E03D 13/00

[52] U.S. Cl. ..... 4/309; 4/222.1

[58] Field of Search ..... 4/309, 222, 222.1, 4/DIG. 5, 300.3, 902, 583, 582, 581, 637, DIG. 18

[56] References Cited

U.S. PATENT DOCUMENTS

| | | | |
|---|---|---|---|
| 2,046,214 | 6/1936 | Selig | 4/222.1 |
| 3,597,772 | 8/1971 | Leavitt et al. | 4/222 |
| 5,313,672 | 5/1994 | Luedtke et al. | 4/309 |

FOREIGN PATENT DOCUMENTS

| | | | |
|---|---|---|---|
| 1210442 | 10/1970 | United Kingdom | 4/583 |

*Primary Examiner*—David J. Walczak
*Attorney, Agent, or Firm*—Donald R. Fraser

[57] ABSTRACT

A urinal screen assembly for disposition adjacent the drain of a urinal is disclosed. The screen assembly includes feet or risers depending from the lower surface to maintain a spaced relation between at least the marginal edge of the assembly to allow liquid to flow therebetween and simultaneously prohibit the passage of unwanted solid materials. The main body portion of the screen assembly is provided with a plurality of tapered apertures which provide fluid communication therethrough and minimizes splash-back caused by an impinging stream of urine.

5 Claims, 2 Drawing Sheets

URINAL SCREEN

BACKGROUND OF THE INVENTION

The present invention relates to urinal screens and more particularly to screens for preventing the flow of foreign materials such as cigarettes, for example, therethrough while permitting the flow of liquids; and simultaneously militating against the splash-back caused by an impinging fluid stream.

The typical screens used in urinals in public restrooms are generally flat perforated members disposed over the urinal drain with the marginal edge thereof completely encircling the drain. The bottom surface of the marginal edge of the screen member typically forms a liquid-tight seal with the adjacent surface of the urinal. Thus, all liquid flowing to the urinal drain is caused to be passed through the perforations in the central portion of the screen assembly. It being understood that the perforations in the central portion of the screen assembly are of a size which will prevent the passage therethrough of any undesired solid materials. However, these perforations oftentimes tend to be substantially clogged with foreign matter causing the flow of water and urine to be greatly impeded, sometimes to a point of overflowing to the adjacent floor area causing rather dreary and unhealthy results.

Also, in addition to the aforementioned clogging problem, the conventional urinal screens may cause a splash-back of urine and urine and water mixture when impacted of the urine stream of a urinating male or the flow of a urine and water mixture during the flushing of the urinal.

SUMMARY OF THE INVENTION

It is an object of the present invention to produce a urinal screen assembly having a marginal edge portion which is provided with depending spacers for causing the edge portion to be slightly spaced from the adjacent surface of the urinal to allow for the flow of liquid therebetween while simultaneously militating against the passage of undesired solid material which would tend to clog the urinal drain.

Another object of the invention is to produce a urinal screen which will significantly reduce the splash-back which occurs when a stream of urine is caused to impact the screen prior to its passage therethrough.

The above and other objects of the invention may be achieved by a urinal screen assembly comprising a main body having an extended upper surface, a corresponding extended lower surface, and a marginal edge portion integral with and surrounding the upper surface and the lower surface; a plurality of spaced apart apertures formed to extend through the body to provide fluid communication between the upper surface and the lower surface of the body; and a plurality of spaced apart feet depending from the body to at least support the marginal edge of the body in spaced relation from a supporting surface.

Further objects and advantages of this invention will be apparent from the following description and appended claims, reference being made to the accompanying drawings forming a part of the specification, wherein like reference characters designate corresponding parts in the several views.

BRIEF DESCRIPTION OF THE DRAWINGS

The above as well as other objects and advantages of the invention will become readily manifest to one skilled in the art from reading the following detailed description of the preferred embodiment of the invention when considered in the light of the accompanying drawings, in which.

DETAILED DESCRIPTION OF THE PREFERRED EMBODIMENT OF THE INVENTION

Figure 1:
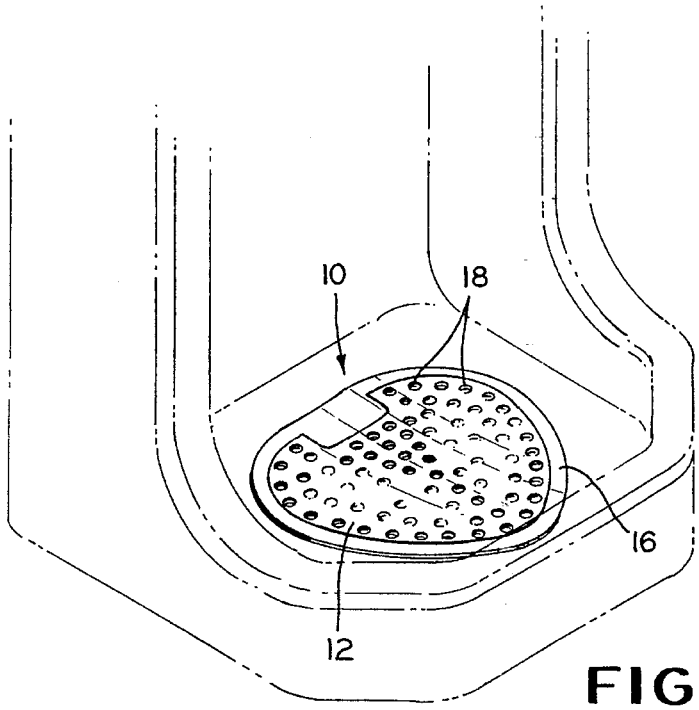
FIG. 1 is a perspective view of a urinal screen incorporating the features of the invention.
Figure 2:
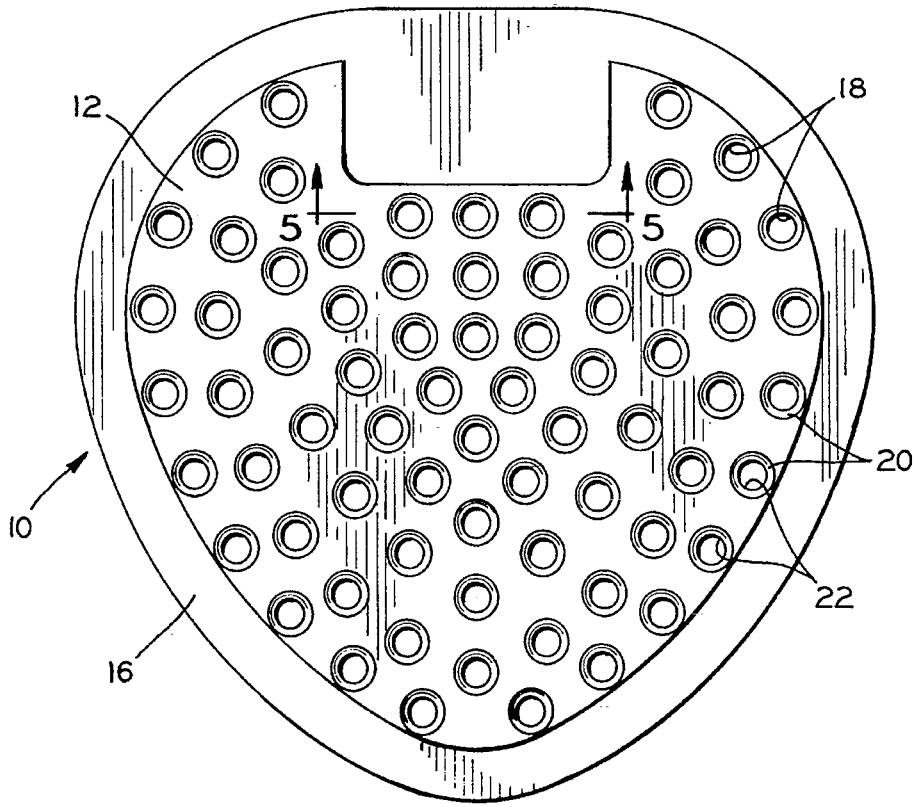
FIG. 2 is a top plan view of the urinal screen illustrated in FIG. 1.
Figure 3:
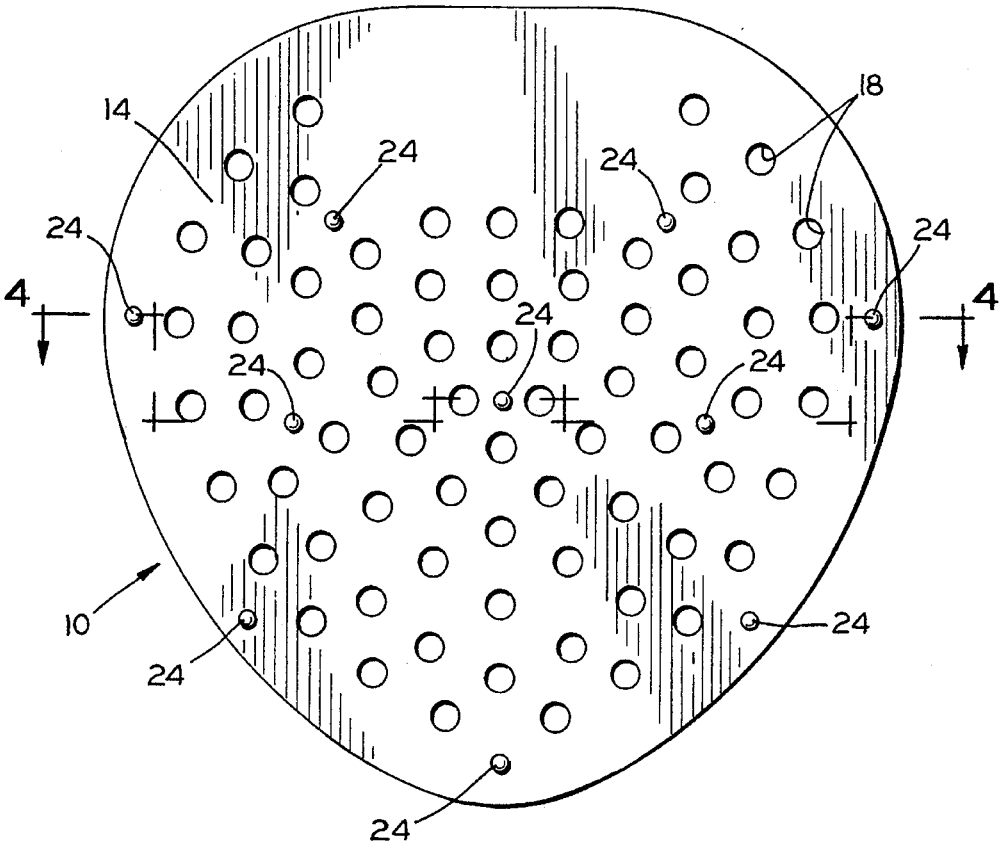
FIG. 3 is a bottom plan view of the urinal screen illustrated in FIGS. 1 and 2.

Referring to the drawings, there is shown a urinal screen having a main body generally indicated by reference numeral 10. The main body 10 is formed of a formable plastic material which will readily accommodate various shaped urinals. Very satisfactory results have been obtained by producing the screen from an injection molded polyvinyl chloride (PVC), for example. The polyvinyl chloride may also be impregnated with a colorant and an essence. The essences used include cherry, bubble gum, greenmint, apple, lemon, orange, and spice. The various essences can be complimented with appropriate respective colorants.

The main body 10 includes an extended upper surface 12, an extended lower surface 14, and a marginal edge portion 16 which is integral with and surrounds the upper surface 12 and the lower surface 14.

A plurality of spaced apart apertures 18 is formed wherein the apertures 18 extend through the body 10 to typically provide fluid communication between the upper surface 12 and the lower surface 14. The apertures 18 are generally circular in section and are formed to taper inwardly from the upper surface 12 to the lower surface 14. The preferred configuration of the apertures 18 is to form a decided inwardly tapered upper section 20, the innermost end of which terminates in a circular cylindrical section 22.

A plurality of spaced apart feet 24 are formed to depend from the lower surface 14. The feet 24 are typically formed to be integral with the main body 10. However, the feet 24 could be formed by ancillary projections separately secured to the lower surface 14. The feet 24 are effective to maintain at least the lower surface of the marginal edge portion 16 in spaced relation from a supporting surface such as the base of the urinal as illustrated in phantom in FIG. 1.

Figure 4:
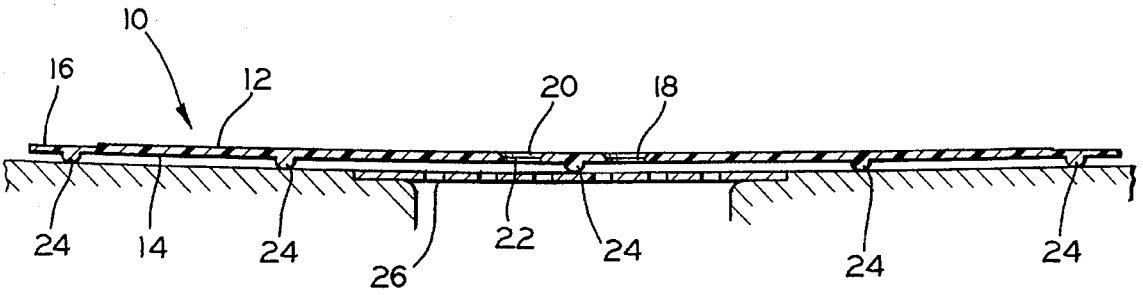
FIG. 4 is a sectional view taken along line 4—4 of FIG. 3.
Figure 5:
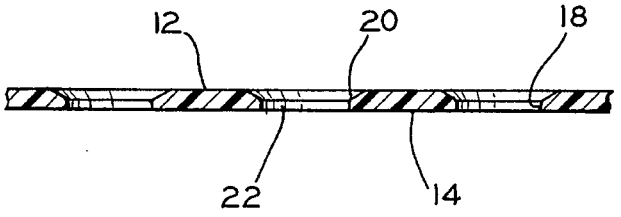
FIG. 5 is an enlarged fragmentary sectional view taken along line 5—5 of FIG. 2.

In operation, the urinal screen 10 is placed over a drain 26 as illustrated clearly in FIG. 4. The depending feet 24 permit the main body 10 to bend and effectively mold itself to the configuration of the body of the urinal.

It will be observed from viewing FIG. 4 that the entire lower surface 14 of the main body 10 is spaced slightly upwardly from the supporting urinal surface. This spaced relation is effective to promote proper flushing action within the urinal and thereby militate against the bacterial build-up.

Further, the tapered configuration of the apertures 18 will effectively prevent splash-back when impacted by a stream of urine. The advantage of such function is obvious.

When it is desired to remove the screen assembly, the screen is grasped and allowed to bend downwardly in the middle so that any screened contents do not spill and become lodged in the urinal drain. The screen assembly is then lifted carefully and the contents emptied. In the event the deodorant impregnated therein has expired, the entire assembly may be disposed of.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A urinal screen assembly comprising:

a main body having an extended upper surface, a corresponding extended lower surface, and a marginal edge portion integral with and surrounding the upper surface and the lower surface;

a plurality of spaced apart apertures formed to extend through said body to provide fluid communication between the upper surface and the lower surface of said body; and a plurality of spaced apart feet depending from said body to at least support the marginal edge portion of said body in spaced relation from a supporting surface whereby a portion of a quantity of liquid flowing along said support surface can flow outside of a boundary defined by said marginal edge portion, beneath said marginal edge portion without flowing over said marginal edge portion and beneath said body.

2. A urinal screen assembly as defined in claim 1 wherein said apertures are formed to taper from the upper surface to the lower surface of said main body.

3. A urinal screen assembly as defined in claim 1 wherein said main body is formed of a formable plastic material.

4. A urinal screen assembly as defined in claim 3 wherein the formable plastic material is polyvinyl chloride.

5. A urinal screen assembly as defined in claim 1 wherein said apertures are larger in the upper surface and decrease in size toward the lower surface.

* * * * *